US006431578B2

(12) United States Patent
Pedersen et al.

(10) Patent No.: US 6,431,578 B2
(45) Date of Patent: Aug. 13, 2002

(54) SKI BINDING

(75) Inventors: Hans Pedersen, Narvik; Trond Olsen, Tromsø, both of (NO)

(73) Assignee: Linken Binding AS, Narvik (NO)

( * ) Notice: Subject to any disclaimer, the term of this patent is extended or adjusted under 35 U.S.C. 154(b) by 0 days.

(21) Appl. No.: 09/466,748

(22) Filed: Dec. 17, 1999

Related U.S. Application Data

(63) Continuation of application No. PCT/NO98/00186, filed on Jun. 18, 1998.

(30) Foreign Application Priority Data

Jun. 20, 1997 (NO) ..... 19972863

(51) Int. Cl.[7] ..... B63C 9/00
(52) U.S. Cl. ..... 280/626; 280/614; 280/618; 280/613
(58) Field of Search ..... 280/611, 613–615, 280/617, 618, 626, 631–634, 636

(56) References Cited

U.S. PATENT DOCUMENTS

| | | | | | |
|---|---|---|---|---|---|
| 3,944,237 | A | * | 3/1976 | Teague, Jr. | 280/615 |
| 4,002,354 | A | * | 1/1977 | Ramer | 280/614 |
| 4,273,355 | A | * | 6/1981 | Storandt | 280/614 |
| 4,513,988 | A | * | 4/1985 | Svoboda | 280/615 |
| 4,917,399 | A | * | 4/1990 | Holzl | 280/615 |
| 4,920,665 | A | * | 5/1990 | Pack et al. | 280/615 |
| 4,993,742 | A | * | 2/1991 | Wittmann et al. | 280/615 |
| 5,066,036 | A | * | 11/1991 | Broughton | 280/615 |
| 5,085,483 | A | * | 2/1992 | Bildner | 280/612 |
| 5,190,309 | A | * | 3/1993 | Spitaler et al. | 280/615 |
| 5,518,264 | A | * | 5/1996 | Broughton | 280/615 |
| 5,560,633 | A | * | 10/1996 | McGowan | 280/614 |
| 5,727,808 | A | * | 3/1998 | Broughton | 280/615 |
| 5,794,962 | A | * | 8/1998 | Bardin et al. | 280/607 |
| 5,984,345 | A | * | 11/1999 | Carter | 280/633 |

FOREIGN PATENT DOCUMENTS

| | | |
|---|---|---|
| CH | 300634 | 10/1954 |
| CH | 518723 | 3/1972 |
| CH | 650687 | 8/1985 |
| EP | 0039489 | 11/1981 |
| FR | 2517550 | 6/1983 |
| WO | 9114483 | 10/1991 |

* cited by examiner

*Primary Examiner*—Brian L. Johnson
*Assistant Examiner*—L. Lum
(74) *Attorney, Agent, or Firm*—Altera Law Group, LLC

(57) ABSTRACT

A ski binding consisting of a front toe section (1) for fixed mounting on the ski (4), and for secure retention of the front part of the ski boot (6), and a rear section (3) for fixed mounting on the ski (4), characterized in that the binding comprises a pivotal rigid plate (20) connected to the front toe section (1) by a movable joint with the aid of a flexible hinge (18), an adjustable heel attachment block (21) having a rear fastener (22) to secure the ski boot (6) to the pivotal plate (20), a rear section (3) fixedly mounted on the ski and having grooves (27) formed therein adapted to the posterior portion of the pivotal plate (20), and means (25) for locking the posterior edge of the plate (20) securely to the ski, and a support bar (26) capable of rotating upward into position below the plate (20).

8 Claims, 11 Drawing Sheets

SKI BINDING

This is a continuation of PCT/NO98/00186 filed Jun. 18, 1998.

BACKGROUND OF THE INVENTION

The present invention relates to a new ski binding. The binding is primarily intended for use in connection with Telemark skiing, but it conceivably can also be used for cross country, especially with the free style or skating technique. The cross country binding will be modified in relation to the binding to be explained in the following, but the principles will be the same. The binding in the invention will provide for very good vertical movement in the connnecting link between the skier and the ski, while the undesirable horizontal lateral movement will be eliminated.

Where bindings currently used in connection with Telemark skiing are concerned, there are a few alternatives that have dominated the market for many years. Whereas there have been made some major changes in the bindings for cross country, alpine and jumping skis in recent years, the process of development has been much slower in the case of bindings for Telemark skis.

One problem with today's well known wire bindings, where the front part of the ski boot is held in place by the toe piece, with the aid of a wire or tightening cable around the heel, is the lack of lateral stability provided by the system.

In addition to the aforementioned poor lateral stability, a traditional wire binding when used for skiing downhill or for executing turns will have the undesirable effect of pressing the tip and front part of the ski down into the snow and creating an imbalance for the skier. With today's binding system the skier does not achieve the stability and control that is desirable.

As examples of other forms of ski bindings, one can mentioned the ski jump binding in NO 178530, which describes a two-part safety binding providing the possibility for stable vertical movement. NO 161957 shows a cross country binding where the ski boot is attached by means of a curved bar and the pivot point between the boot and binding is in front of the boot.

EP 039489, CH 650687 and NO 164642 all describe ski bindings where the pivotal point is located in front of the ski boot.

SUMMARY OF THE INVENTION

The ski binding according to the invention will provide for a system offering a very effective transfer of power and stability between the skier and the ski. The ski binding will give a very good possibility for vertical movement of the heel of the ski boot, while the undesirable lateral movement is eliminated.

This is achieved according to the invention with a ski binding consisting of a front toe section for fixed mounting on the ski and for secure retention of the front part of the ski boot, and a rear section for fixed mounting on the ski, characterized in that the binding comprises a pivotal rigid plate connected to the front toe section by a movable joint with the aid of a flexible hinge, an adjustable heel attachment block having a rear fastener for attachment of the ski boot to the pivotal plate, a rear section fixedly mounted to the ski and having grooves formed therein adapted to the posterior portion of the pivotal plate, and means for locking the posterior edge of the plate securely to the ski, and a support bar capable of rotating upward into position below the plate.

BRIEF DESCRIPTION OF THE DRAWINGS

The present invention will be explained in more detail with reference to the figures, wherein.

DESCRIPTION OF THE INVENTION

Figure 1:
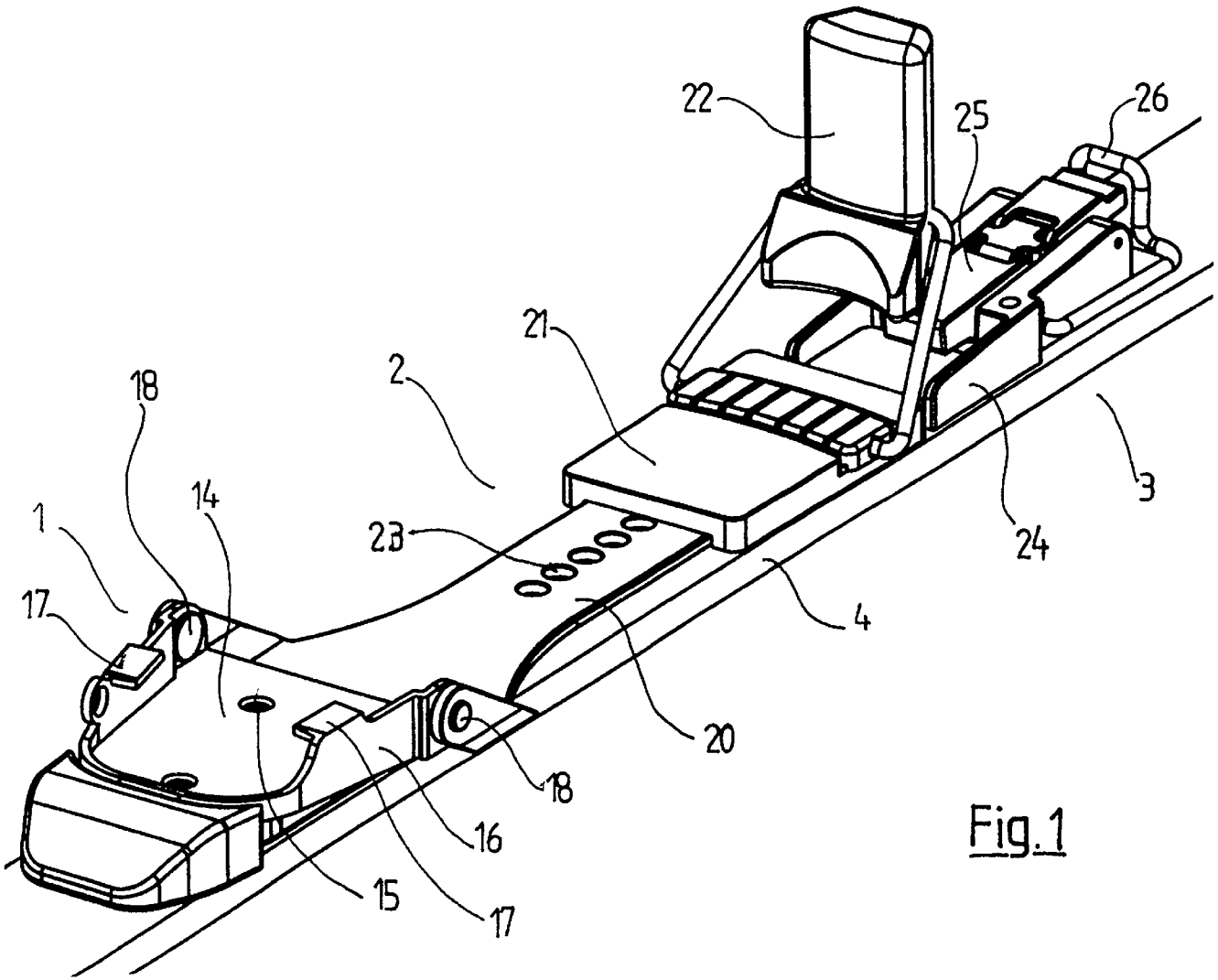
FIG. 1 shows the binding from the front.
Figure 2:
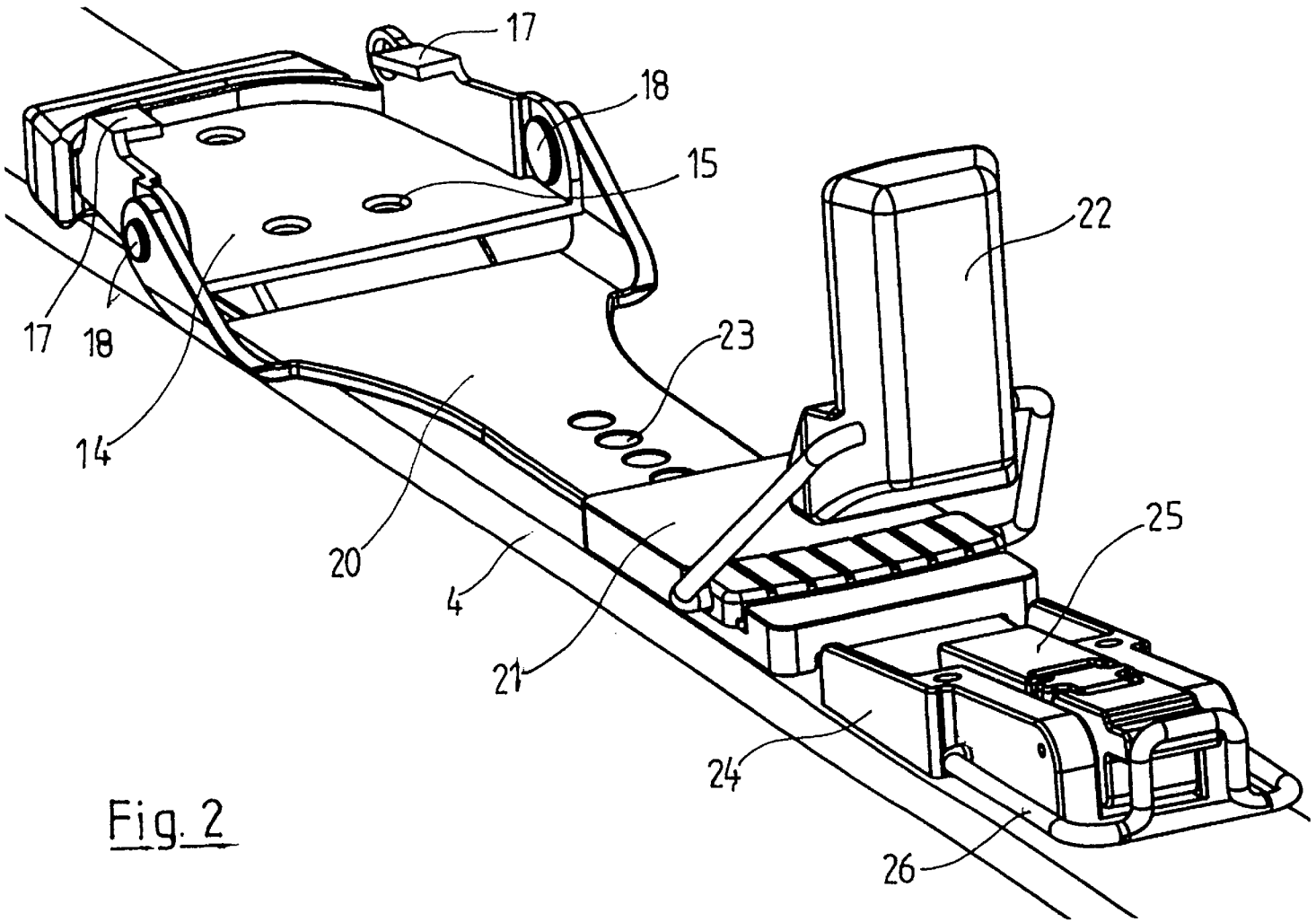
FIG. 2 shows the binding from the back.
Figure 3:
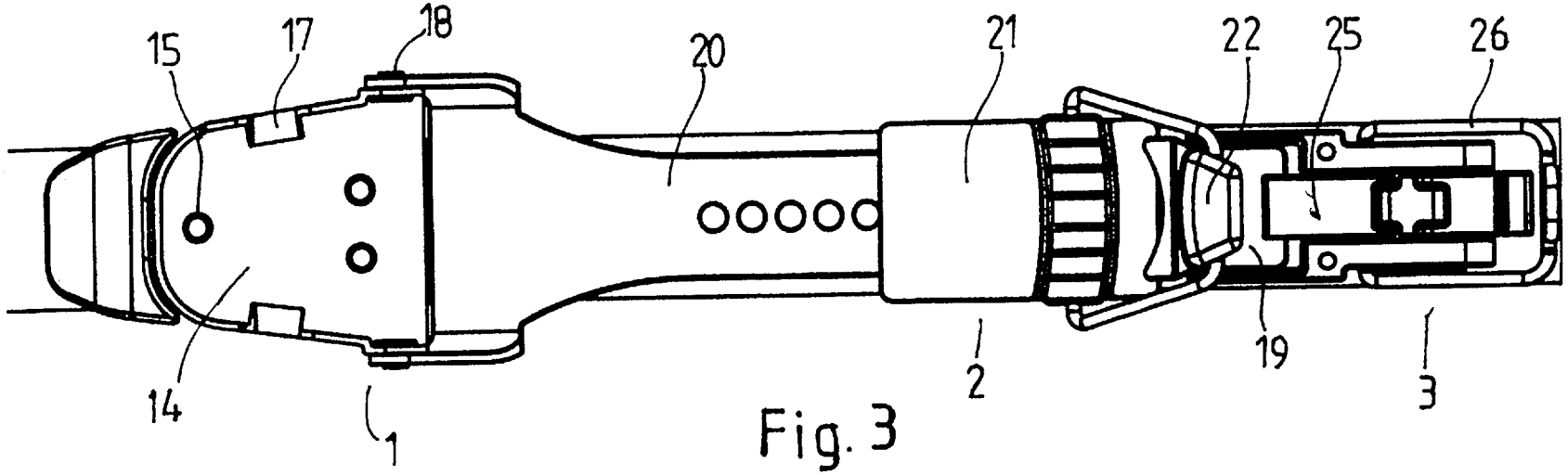
FIG. 3 shows the binding from the top.
Figure 4:
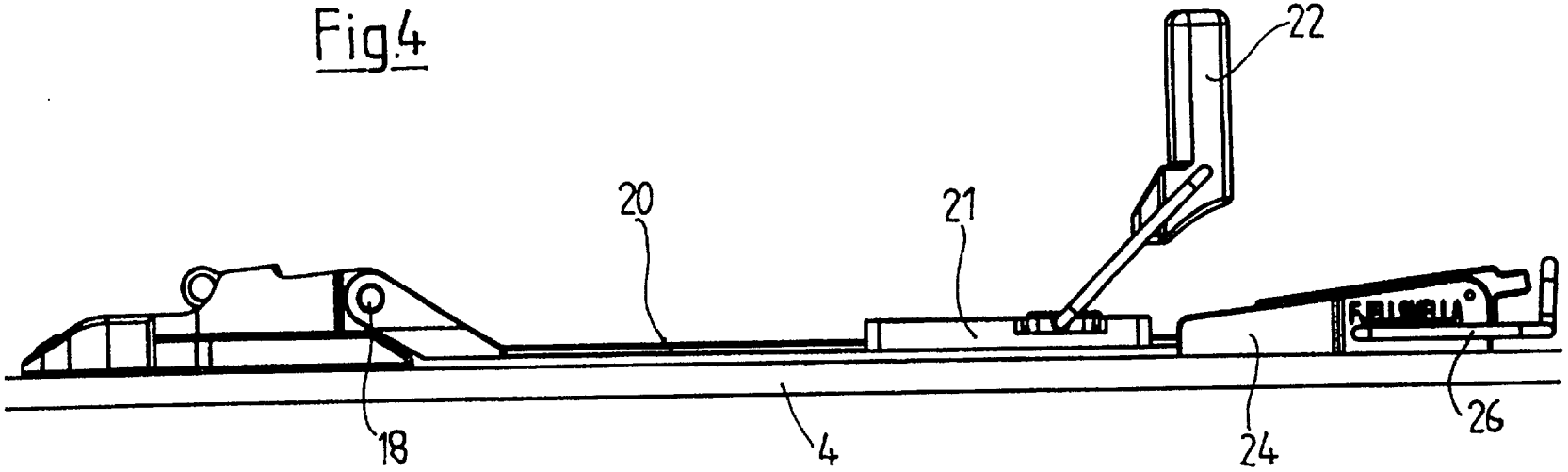
FIG. 4 shows the binding from the side.
Figure 5:
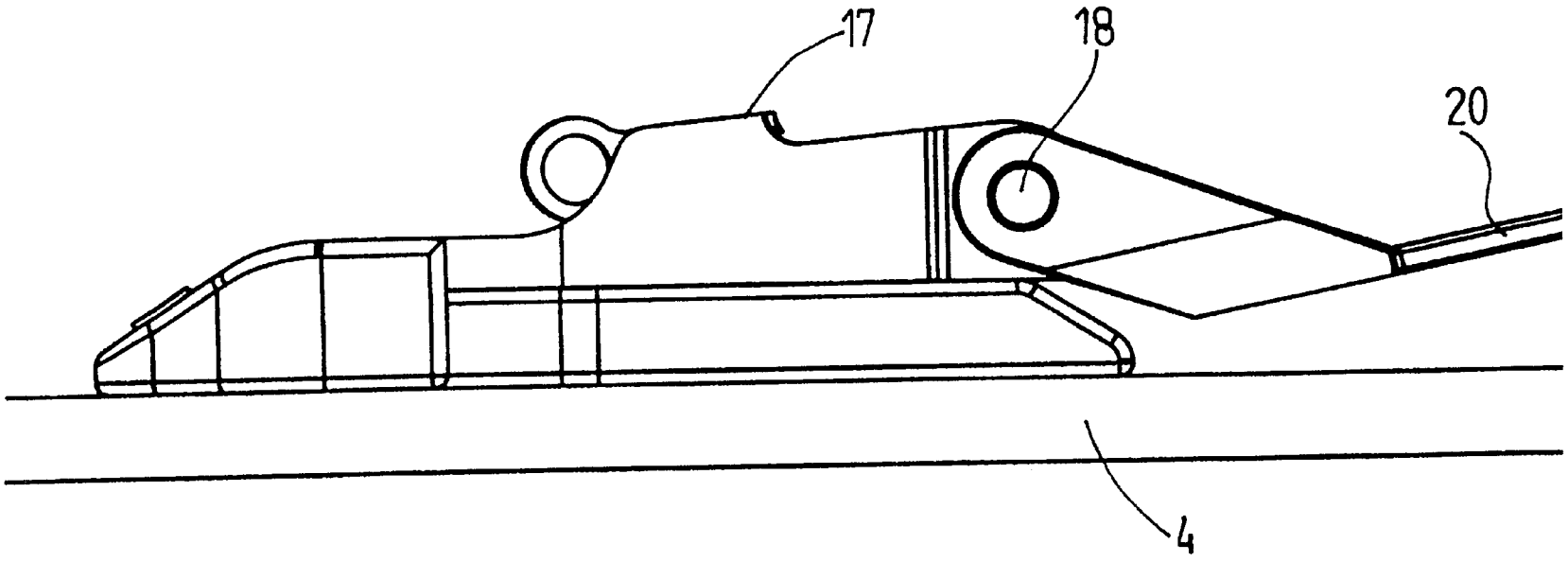
FIG. 5 shows a detail of the flexible hinge on the front part of the binding.

The figures show the complete binding consisting primarily of a toe section 1 for insertion of a ski boot 6, a plate section 2 having adjustable length and a heel attachment means, and a heel section 3 having a heel block and a support bar.

Toe section 1 basically has a standard width adapted to fit the most conventional ski boots. Where Telemark boots are concerned, the binding width is 75 mm, but the invention is not limited to this width. A cross country binding will, for example, have a narrower toe section. Toe section 1 is attachable to the ski by means of a plurality of screws 15 or optionally glue. Toe section 1 optionally may have an elevation plate 14 that "lifts" the binding and the boot up from the ski 4. This elevation plate will enable the skier more easily to "edge" the ski or, in other words, to form an angle between the ski and the base surface in order to execute a cutting turn. With elevation plate 14 the skier will use less force to achieve this angling between ski and surface. The height or the thickness of the elevation plate will vary and must be adapted to the skier's skill. Toe piece 16 forms a frame that fits the tip of the ski boot 6 laterally and toward the front. The toe piece is provided with at least two toe piece lugs 17 on each side of the boot tip and ensures that the top of the ski boot is held in place in the vertical direction, thereby preventing the boot from being lifted undesirably out of the binding.

At the rear edge of toe piece 16 on both sides of the binding are provided two flexible hinges 18 that are connected to a vertical, pivotally movable plate 20. For this connecting hinge there may used screws with nuts, pins or other robust fastening means. Plate 20 has apertures 23 or other means to permit the mounting of an adjustable heel attachment block 21 which also contains release mechanisms and a rear fastener 22. Plate 20 with its apertures permits the adjustment of the binding according to the length and size of the ski boot. The height of the heel attachment block 21 should preferably be equal to the height of elevation plate 14, so that the ski boot stands in a horizontal position relative to the ski 4 when guide plate 20 lies flat. Rear fastener 22 is provided with a built-in release mechanism which will ensure that the ski boot is released from the binding on exertion of a strong force, and in this manner prevents fracture and twisting injuries in the skier. The force that is necessary to activate the release mechanism is adjustable and will depend on various factors such as the skill of the user, the character of the ski hill, etc.

Plate 20 has at its rear edge 19 an end section that fits into the heel block 24. The heel block has approximately vertical, conical walls that ensure that plate 20 is lowered in a natural manner down between the conical walls. This means that horizontal, lateral movement will be prevented, but plate 20 is still able to move up and down in the vertical direction. The main function of heel block 24 is to support the rear edge 19 of plate 20 laterally in order to prevent horizontal movement. This relieves the load on the flexible hinge 18 between toe piece 16 and plate 20 when the pressure is greatest, i.e., when the plate and ski boot 6 are in contact with the ski along the entire length of the binding. The heel block also has a locking mechanism 25 capable of being locked when the guide plate 20 is in lower position, permitting the binding to be used as an ordinary alpine binding, meaning that the heel is securely locked and cannot be lifted from the ski. This locking mechanism 25 consists of a handle capable of being pushed back and forth by the skier to lock the rear edge 19 of plate 20 when this is desired.

Figure 6:
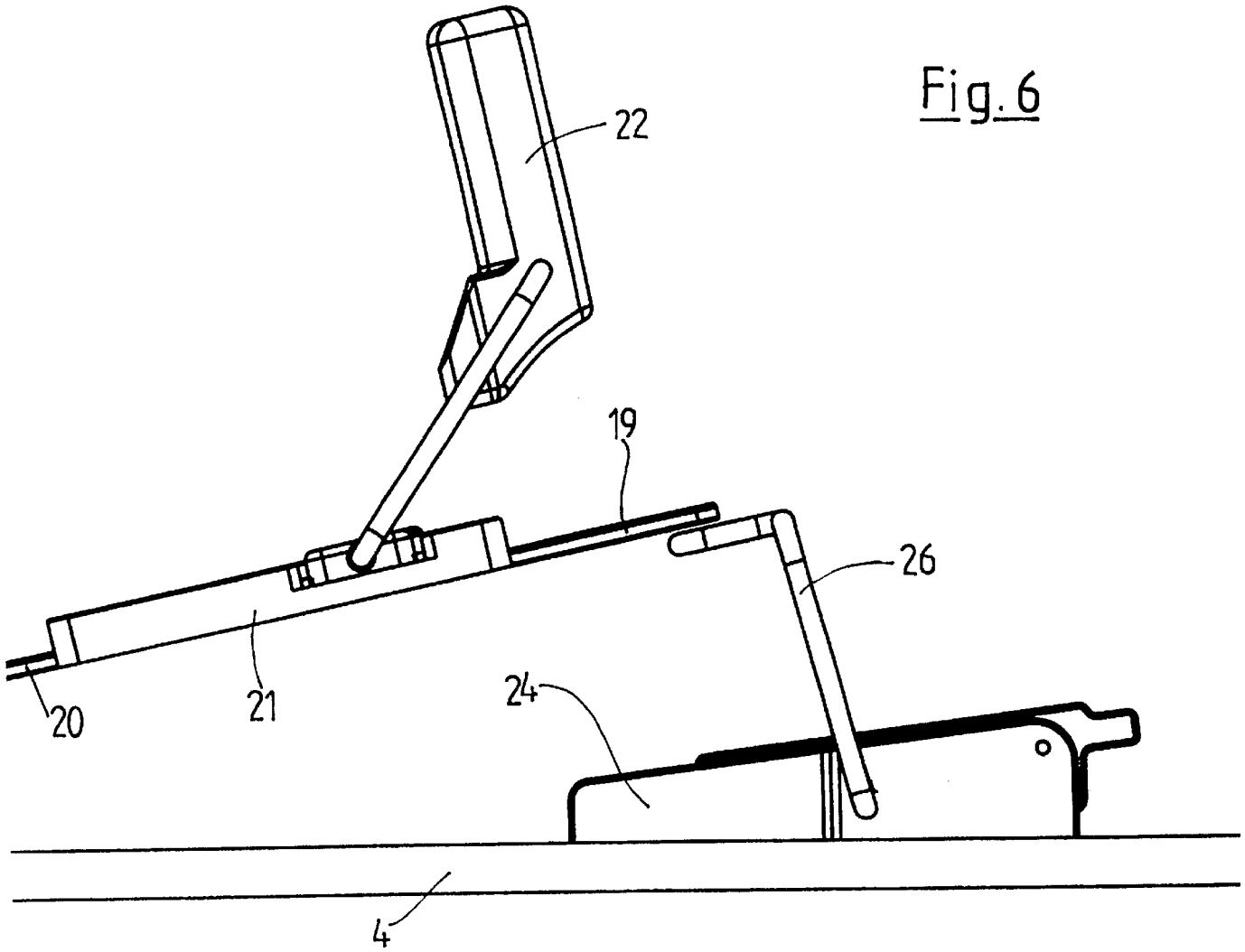
FIG. 6 shows the rear part of the binding with heel block and support bar.
Figure 7:
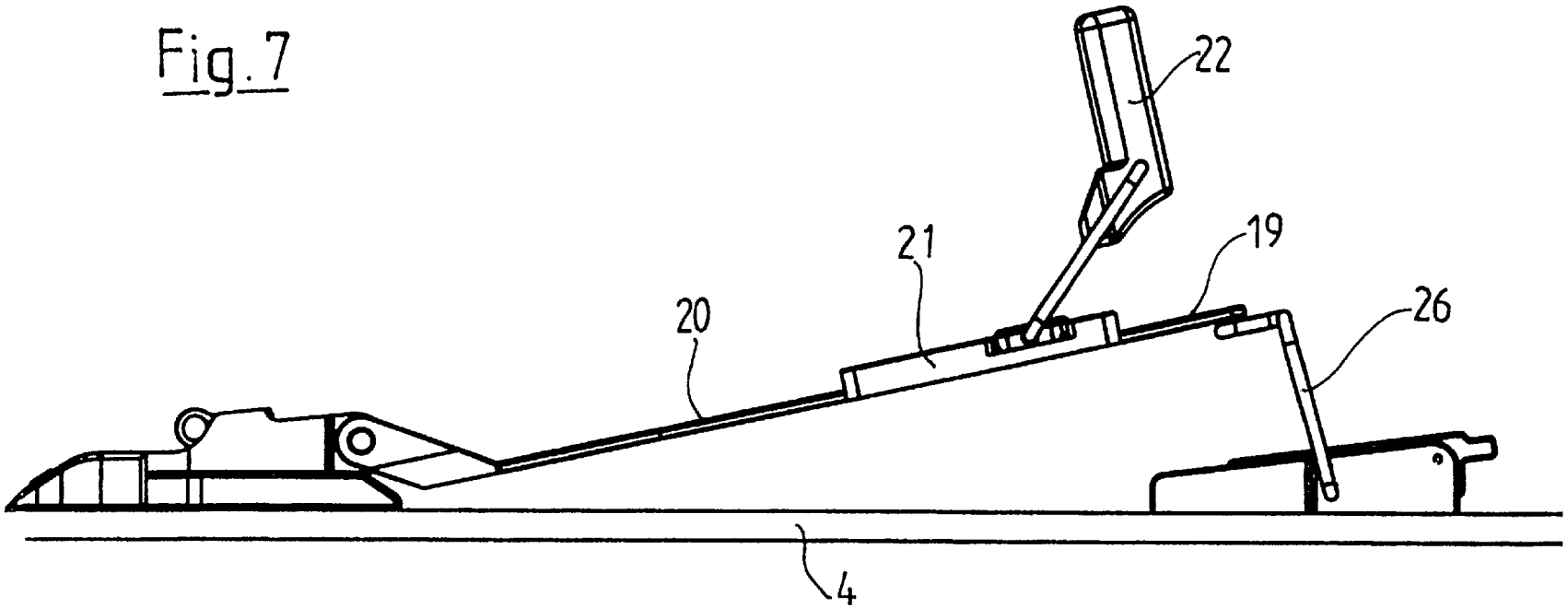
FIG. 7 shows the complete binding with raised support bar.
Figure 8:
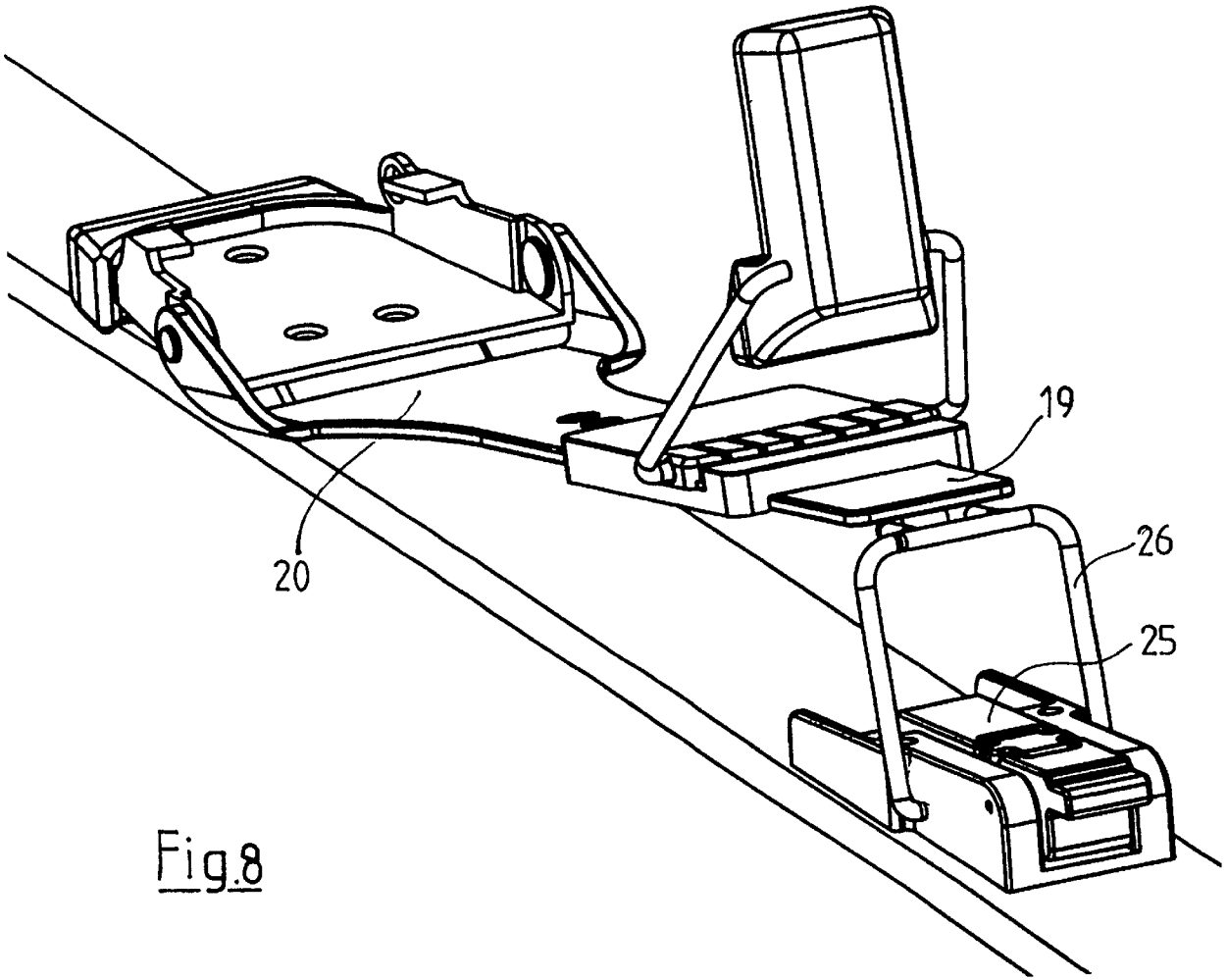
FIG. 8 shows the same as FIG. 7, but viewed from the back.
Figure 9:
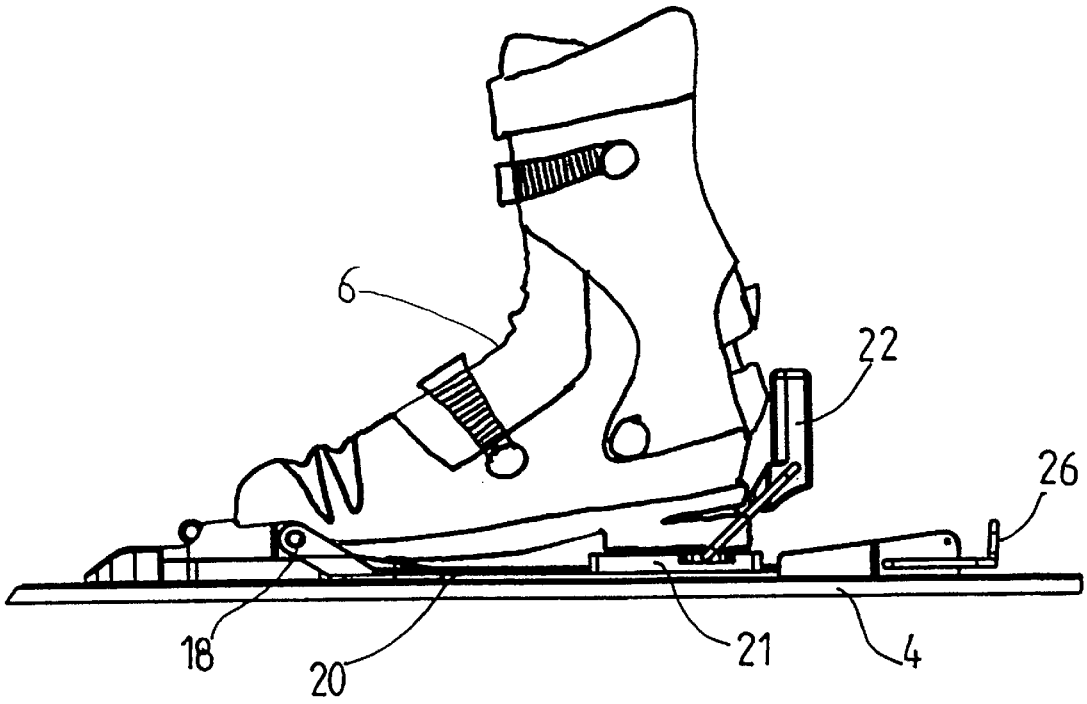
FIG. 9 shows a binding with a boot.
Figure 10:
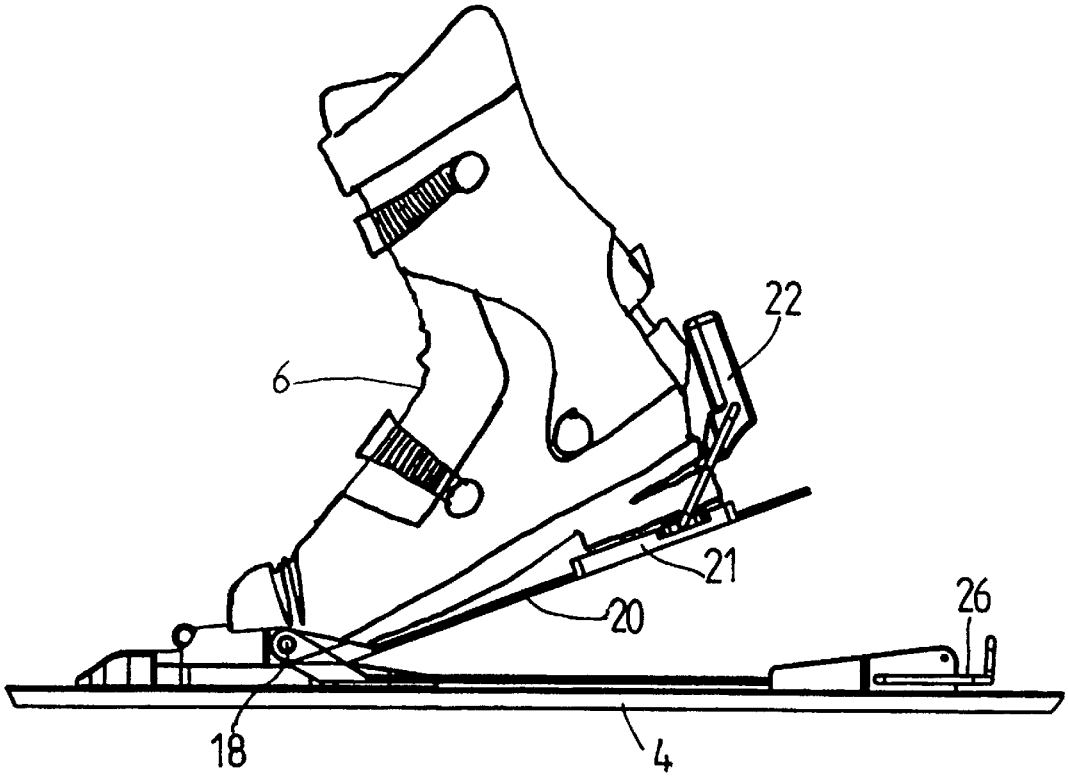
FIG. 10 shows the binding with a flexed boot.

As extra equipment the heel section 3 may be provided with support bar 26. In its raised position this can be a support point for plate 20 so that the plate forms a fixed angle with ski 4 as shown on FIGS. 6 and 7. This is particularly important when the skier makes ascents in hilly terrain, where the strain on the leg muscles and ligaments will be reduced by the use of support bar 26.

Figure 11:
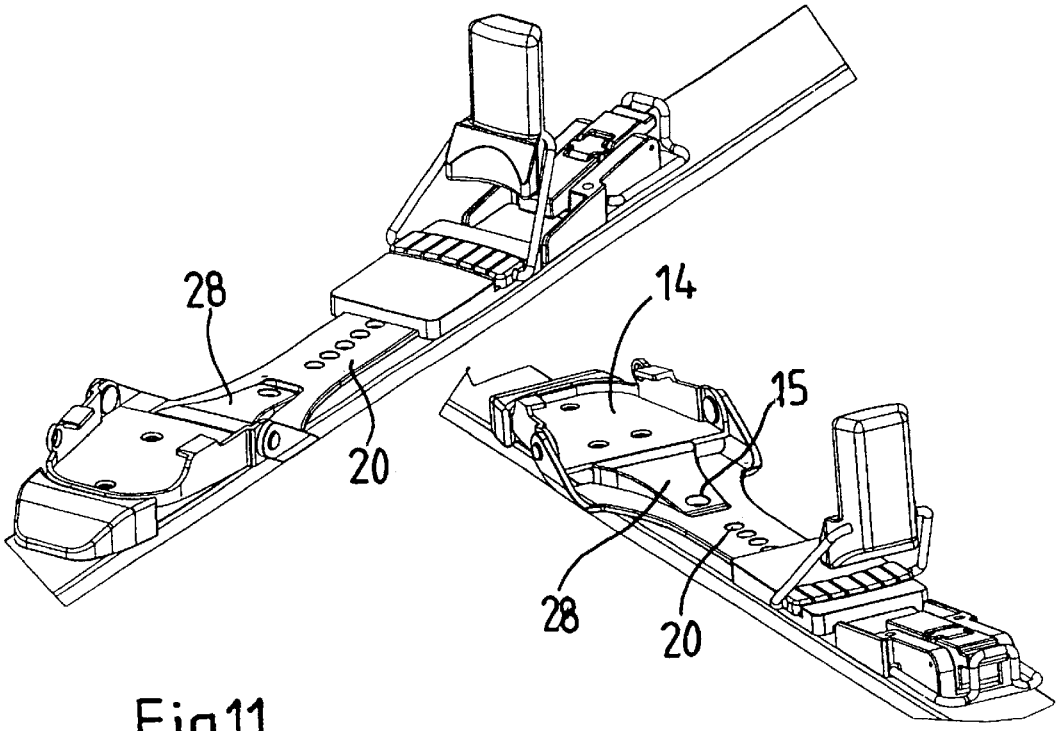
FIG. 11 shows an alternative design of the flexible hinge.

FIG. 11 shows an alternative embodiment of flexible hinge 18. Toe piece 16 is extended toward the rear in a tapering joint 28 having at the rear edge thereof a screw fastener 15. Plate 20 has a complementary shape in relation to the tapering joint 28.

The binding according to the invention will ensure that more of the energy generated by the skier will be transferred through the binding to the ski. The energy from the skier through the binding will be transferred in its entirety to the ski by virtue of the fact that no energy is lost in lateral, horizontal movement. The compressive force between the ski and the snow is thereby increased, enabling the attainment of better control and increased stability, which in turn makes it possible to execute the desired ski turns.

What is claimed is:

1. A ski binding comprising a front toe member for fixed mounting on a ski, said front toe member having a forward toe member, a rearward toe member, and at least one restrainer to immobilize a forward part of a ski boot, an elongated rigid plate member pivotally connected at a forward end to the rearward toe member end of the front toe member by at least one hinge member, the plate member engaging a bottom of the boot from a ball-of-the-foot portion of the boot to a heel portion of the boot, a heel attachment block attached to a rearward end of said plate member for securing the heel portion of said boot to the plate member, and, a rear member for fixed mounting on the ski, said rear member being adapted to receive a posterior portion of the plate member, and including locking means for selectably holding the posterior portion of the plate member, wherein a support surface is arranged on said front toe member to support a bottom surface of said forward part of said boot between a toe portion and the ball-of-the-foot portion of the boot, and, a pivot is disposed elevated from said support surface and essentials transverse to a longitudinal axis of said plate member, such that the boot is flexed proximate the ball-of-the-foot portion of the boot that sits atop said pivot when said plate member is rotated on said pivot with respect to said front toe member.

2. A ski binding according to claim 1, wherein said rear member has an opening for receiving the posterior portion of the plate member, said opening being tapered by means of conically shaped side walls and being complementary at is bottom with the posterior portion to the plate member.

3. A ski binding according to claim 1, wherein said locking means comprises a manually displaceable locking mechanism.

4. A ski binding according to claim 1, wherein a support bar is lockable in a rotated position to establish a defined angular relationship between the front toe member and the plate member.

5. A ski binding according to claim 1, wherein said heel attachment block is adjustable attached to said plate member by virtue of apertures provided in the plate member and lockable fastening means provided in the heel attachment block, adapted to fit into said apertures.

6. A ski binding according to claim 1, wherein said pivot is positioned distant from said restrainer such that the ski boot will be flexed, in response to pivotal movement of the plate member at a point in the ski boot at the user's ball-of-the-foot.

7. A ski binding according to claim 1, wherein said pivot includes a hinge which is elevated above said support surface.

8. A ski binding according to claim 1, further including a support bar capable of being rotated into position below the plate member.

* * * * *